US008210585B2

(12) United States Patent
Molteni

(10) Patent No.: US 8,210,585 B2
(45) Date of Patent: Jul. 3, 2012

(54) ELECTROMAGNETIC LIFTER FOR MOVING COILS OF HOT-ROLLED STEEL AND RELEVANT OPERATING METHOD

(75) Inventor: Danilo Molteni, Manerbio BS (IT)

(73) Assignee: SGM Gantry S.p.A. (IT)

( * ) Notice: Subject to any disclaimer, the term of this patent is extended or adjusted under 35 U.S.C. 154(b) by 264 days.

(21) Appl. No.: 12/672,703

(22) PCT Filed: Aug. 10, 2007

(86) PCT No.: PCT/IT2007/000583

§ 371 (c)(1),
(2), (4) Date: Feb. 9, 2010

(87) PCT Pub. No.: WO2009/022357

PCT Pub. Date: Feb. 19, 2009

(65) Prior Publication Data

US 2011/0140468 A1 Jun. 16, 2011

(51) Int. Cl.
*B66C 1/06* (2006.01)
*H01F 7/20* (2006.01)

(52) U.S. Cl. ..... 294/65.5; 294/907; 335/289

(58) Field of Classification Search ..... 335/289, 335/290, 291, 294, 295; 294/65.5, 907
See application file for complete search history.

(56) References Cited

U.S. PATENT DOCUMENTS

| | | | | |
|---|---|---|---|---|
| 3,596,967 | A | 8/1971 | Carter | |
| 3,783,344 | A | 1/1974 | Ono et al. | |
| 4,350,379 | A * | 9/1982 | Peroutky | 294/65.5 |
| 4,965,695 | A * | 10/1990 | Baumann | 361/142 |
| 5,449,211 | A * | 9/1995 | Monford, Jr. | 294/65.5 |
| 6,104,270 | A | 8/2000 | Elias | |
| 6,489,871 | B1 * | 12/2002 | Barton | 335/285 |
| 2002/0190826 | A1 * | 12/2002 | Molteni | 335/291 |

FOREIGN PATENT DOCUMENTS

DE 19531513 A1 2/1997

* cited by examiner

*Primary Examiner* — Dean Kramer
(74) *Attorney, Agent, or Firm* — Akerman Senterfitt

(57) ABSTRACT

An electromagnetic lifter includes at least two polar expansions shaped for transporting a horizontal axis coil of hot-rolled steel. The polar expansions are connected through a ferromagnetic circuit and respective cores around which solenoids are arranged. A detection coil is arranged around each of the cores suitable to detect the change in the flux linked to the coil, and a control unit connected to the detection coils compares the values detected by each of them in order to authorize or not the transport. The relevant operating method includes a first check that the difference between the values detected by the two detection coils is below a preset threshold, and in the affirmative a second check that the overall decrease in the linked flux is below a second preset threshold, the issuance of an authorization signal to the transport being possible only in case of positive outcome of both checks.

12 Claims, 5 Drawing Sheets

ELECTROMAGNETIC LIFTER FOR MOVING COILS OF HOT-ROLLED STEEL AND RELEVANT OPERATING METHOD

The present invention relates to lifters used for moving coils of hot-rolled steel, and in particular to an electromagnetic lifter provided with a safety device.

It is known that coils of hot-rolled steel consist of a spiral-wound strip of electromagnetic sheet having a length up to 3000-3500 m and a weight ranging from 15 to 45 t, the spiral shape being maintained by a containment strapping. Exactly due to this nature, a coil acts like a large spring whose external turns are subjected to a strong dynamism owing to the intrinsic elasticity of the system, whereby the coil can not be considered as an integral block.

These dynamic aspects occur in that the sheet is wound at high temperature (500-600° C. and even more) and subsequently the coil is laid on the ground for the cooling phase. During said phase, the sheet gets shorter, its thickness gets smaller and the last turns are loaded with an energy that tends to move the sheet outwards. This happens because the natural shrinkage process can not take place completely since the coil is strapped with its turns tightly wound, and is laid on the ground or in anti-roll stalls at an horizontal axis position when it is still very hot.

The combination of these factors causes in the coil a loosening of the turns and a physical deformation concentrated in the coil portion facing upwards, and this deformed region coincides with the grip area by the lifter, intended to transfer the coil. For this reason, lifters used to transport coils are mainly of the mechanical type in that they guarantee a safe lifting of the coil regardless of the deformed grip area and of the dynamism of the spiral structure.

However, it would be preferable to use electromagnetic lifters that are more efficient and faster than mechanical lifters yet they are affected by the above-mentioned particular characteristics of the coils of hot-rolled steel.

In fact, a standard electromagnetic, lifter is suitable for the purpose as long as in the coils do not occur those mechanical dynamisms that may trigger magnetic dynamisms that lead to a reduction of the lifting force, up to the detachment of the load during transport, but this phenomenon is presently impossible to foresee with conventional lifters.

In the initial magnetization step an electromagnet can compact the loosened turns of a coil in the region of its polar expansions, even merely through its own weight. In this way, the magnetic flux linked between the electromagnet and the coil is sufficient to achieve an anchorage force greater than twice the coil weight, so that it suitable to lift and transport the coil according to the EN 13155 standard. A flux meter possibly located in the close proximity of the polar expansions of said electromagnet would therefore detect during the transitory magnetization step a flux value and thus a magnetic induction value suitable to comply with said safety standard.

The problem of the electromagnetic lifter is that of detecting in the initial lifting step the elasticity of the turns affected by the magnetic field. In fact said mechanical dynamism can cause a more or less marked detachment of the external turns actually causing a decrease in the cross-sectional area of the flux lines, with consequent quadratic decrease in the anchorage force of the electromagnet that is proportional to the square of the induction. This combined mechanical-magnetic effect between the coil and the electromagnet is defined hereafter "magnetic dynamism" for the sake of simplicity.

If this magnetic dynamism exceeds a critical threshold, it is very probable that the loosening of the steel turns of the coil will continue thus causing a further decrease in the linked flux lines. This can in turn trigger a chain reaction of further detachments and decreasing of flux lines up to making the lifting dangerous and not compliant with the EN 13155 standard, with the clear risk of load loss during the transport phase.

The problem may arise even if the magnetic dynamism occurs only at one of the polar expansions, since in said case the other polar expansion that generates a greater lifting force also generates a lever effect against the area of lower induction. This can trigger the accelerated loosening of the turns on the same side that already suffers from the magnetic dynamism, greatly increasing the probability of detachment of the coil.

Therefore the object of the present invention is to provide an electromagnetic lifter which is free from said drawbacks. This object is achieved by means of an electromagnetic lifter comprising a safety device suitable to check in the initial lifting step the magnetic dynamism of each polar expansion as well as the overall magnetic dynamism of the lifter prior to authorizing the transport manoeuvre. Other advantageous features of the present lifter are disclosed in the dependent claims.

The fundamental advantage of the present lifter stems from the fact that it can perform the transfer of hot-rolled steel coils in a condition of absolute safety, thus combining the practicality of electromagnetic lifters with the safety of mechanical lifters.

A second significant advantage results from the fact that said safety is obtained through a simple, inexpensive and reliable device.

Further advantages and characteristics of the lifter according to the present invention will be clear to those skilled in the art from the following detailed description of an embodiment thereof, with reference to the annexed drawings wherein.

Figure 1:
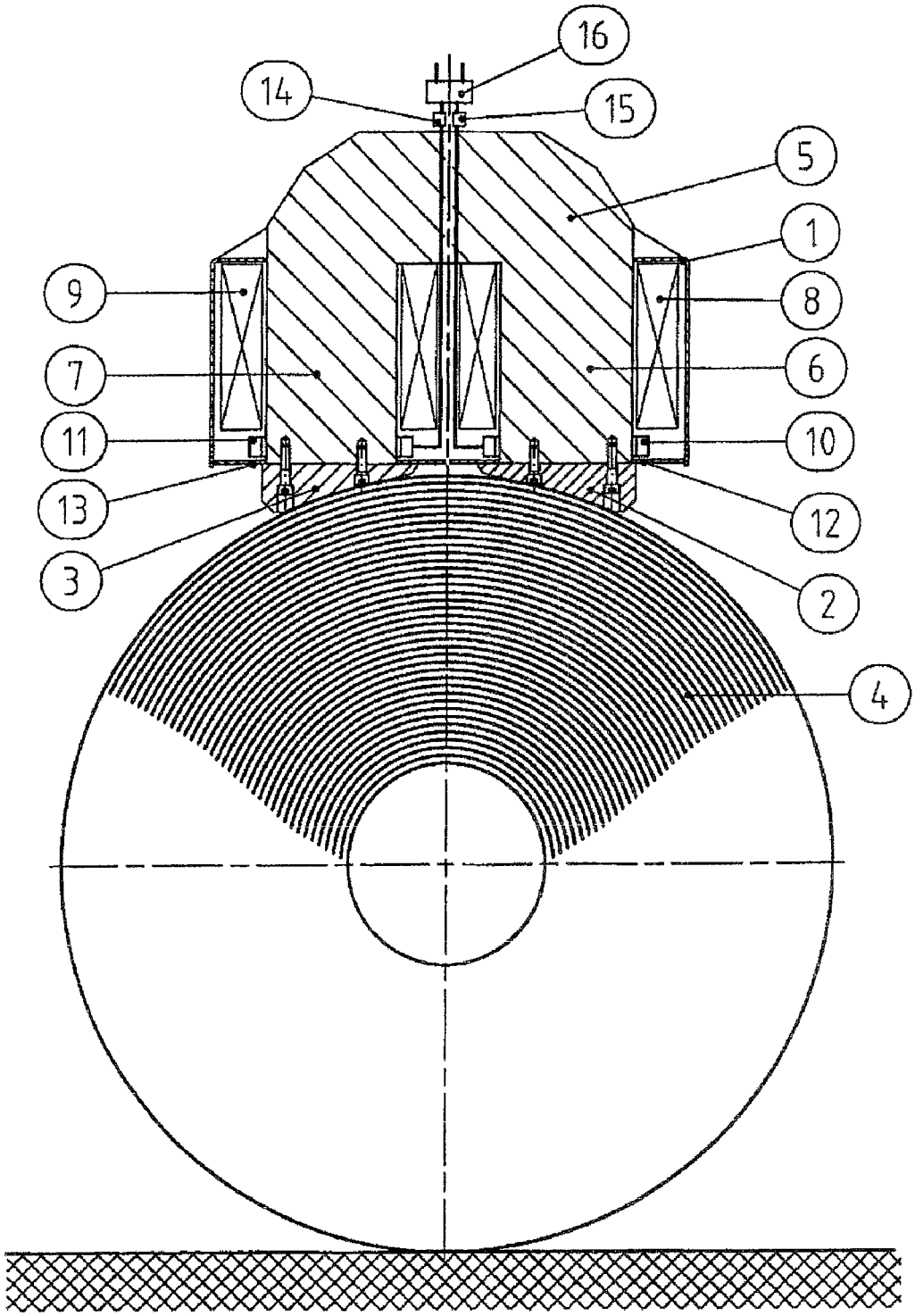
FIG. 1 is a diagrammatic front sectional view of a lifter according to the invention.
Figure 2:
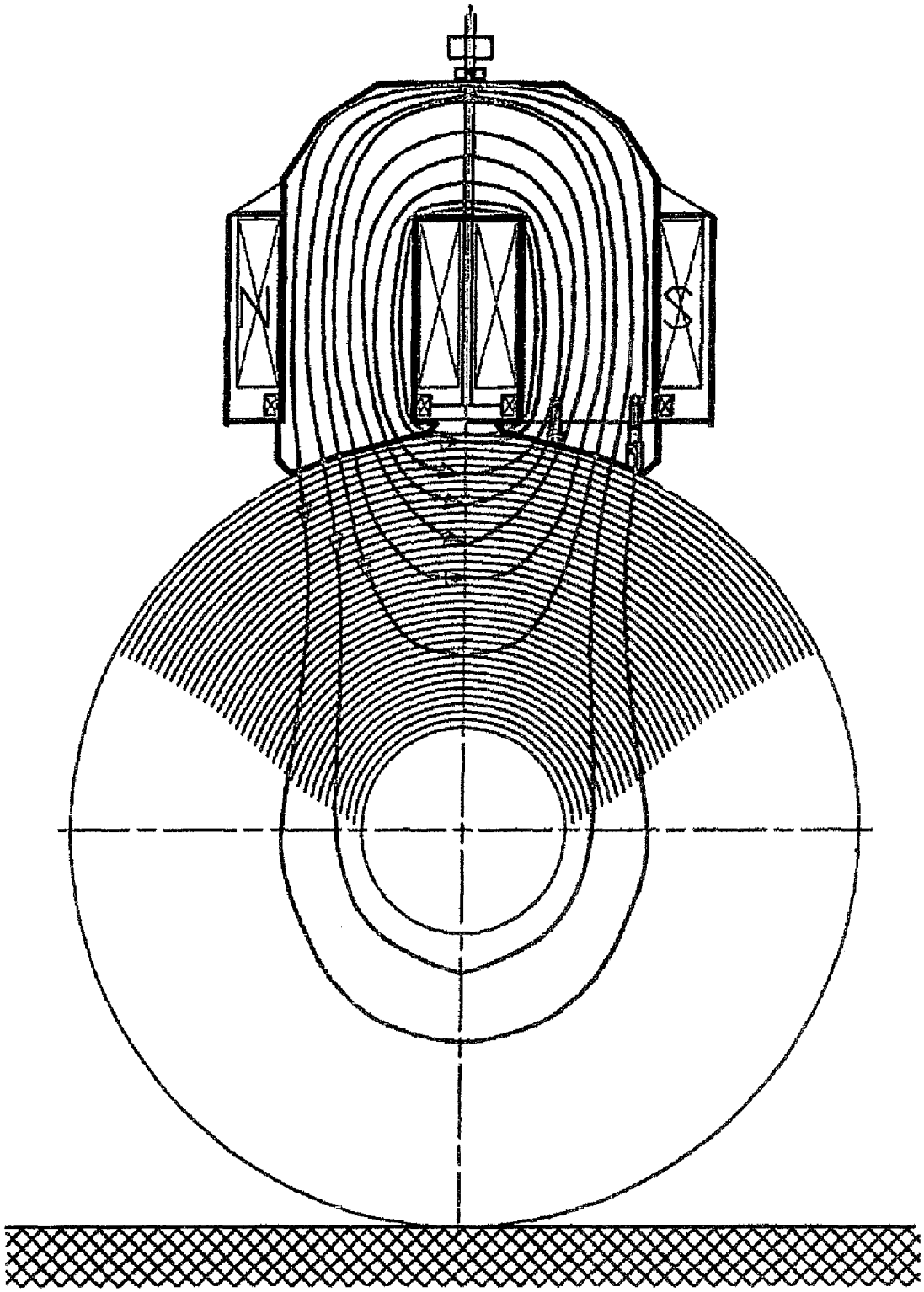
FIG. 2 is a view similar to the preceding one that diagrammatically shows the operation of the lifter.
Figure 3:
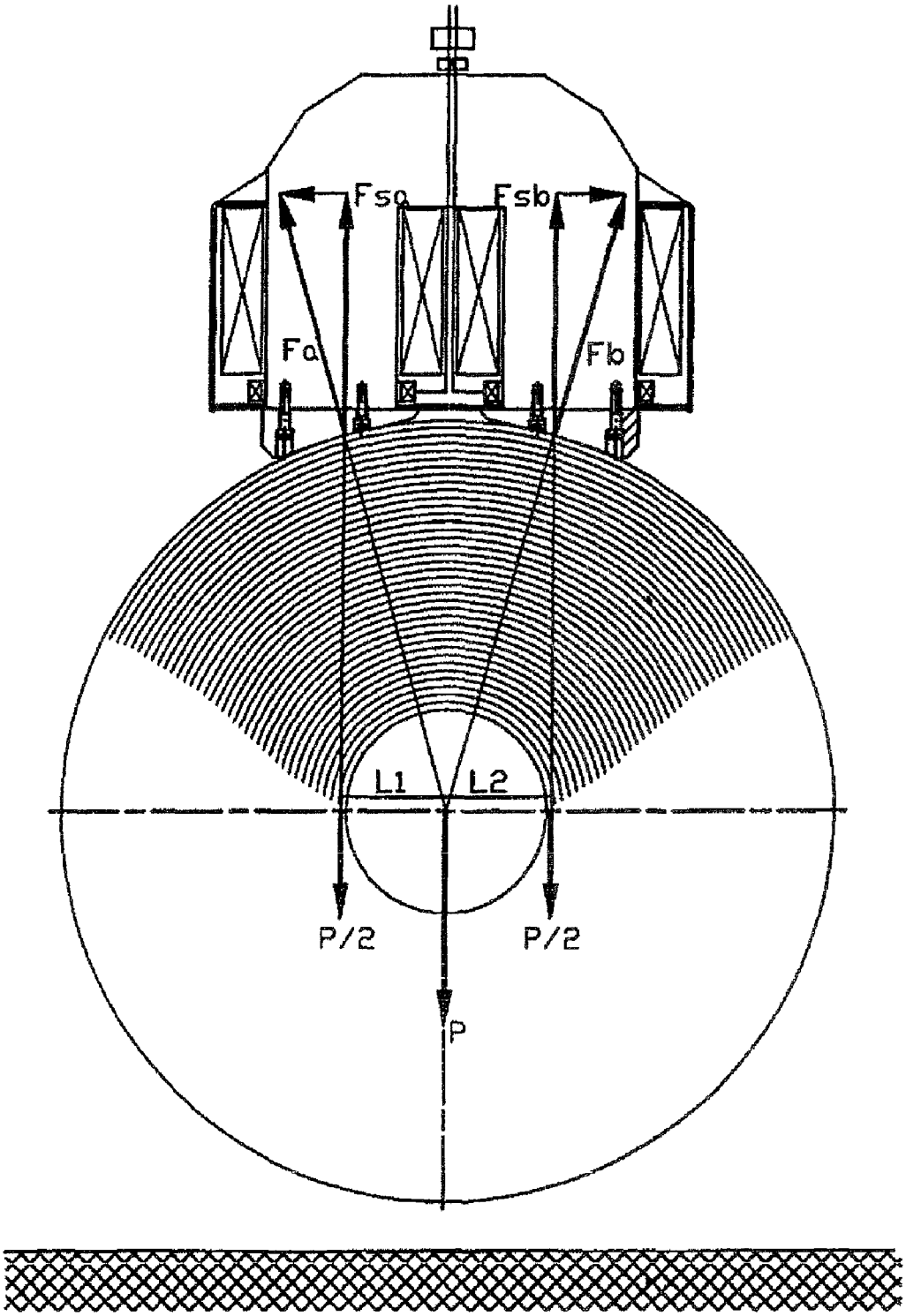
FIG. 3 is a view similar to the preceding one that shows the force system in a condition of load engagement.

Referring first to FIGS. 1-3, there is seen that an electromagnetic lifter according to the present invention conventionally includes two polar expansions 2, 3, shaped for transporting a horizontal axis coil 4, connected through a ferromagnetic circuit 5 and two cores 6, 7. Two solenoids 8, 9 respectively arranged around said cores 6, 7 generate the magnetomotive force that allows to lift coil 4. It should be noted that although electromagnet 1 described here is preferably bipolar said choice is not binding, since magnets with different numbers of poles properly provided with the required devices can be manufactured by the same principle.

The novel aspect of the present lifter resides in the presence of two detection coils 10, 11, preferably of enamelled copper, respectively arranged around the cores 6, 7 close to the polar expansions 2, 3. Said coils 10, 11 are preferably protected by respective plates 12, 13 against the heat transmitted by coil 4 that in some cases is transported still hot.

Coils 10, 11 can detect the magnetic dynamism in the initial lifting step since they are crossed by the flux lines generated by solenoids 8, 9 and linked to coil 4, and therefore are capable of detecting the amount of the decrease of said linked flux lines (negative magnetic dynamism) caused by the mechanical dynamism of the turns of coil 4 when it is lifted. This information is transmitted to two respective A/D converters 14, 15 that forward the data in digital format to a control unit 16 whose purpose is to grant or deny the authorization for transport.

The operation of the present lifter is therefore quite simple and effective and is readily understood: the polar expansions 2, 3 contact coil 4 to be lifted and, upon activation of solenoids 8 and 9, the flux lines link to coil 4 as shown in FIG. 2. At the beginning of the lifting step, in the absence of magnetic dynamism, the system balance condition is illustrated by the force system of FIG. 3.

In said system, Fa indicates the anchorage force of pole a (N pole in the example of FIG. 2), Fb indicates the anchorage force of pole b (S pole in the example of FIG. 2), Fsa and Fsa indicate the vertical lifting components of said anchorage forces, L1 and L2 indicate the lever arms measuring the distance between the barycentric axis of the load (P) and said vertical components Fsa and Fsb that hold half load (P/2) each.

Figure 4:
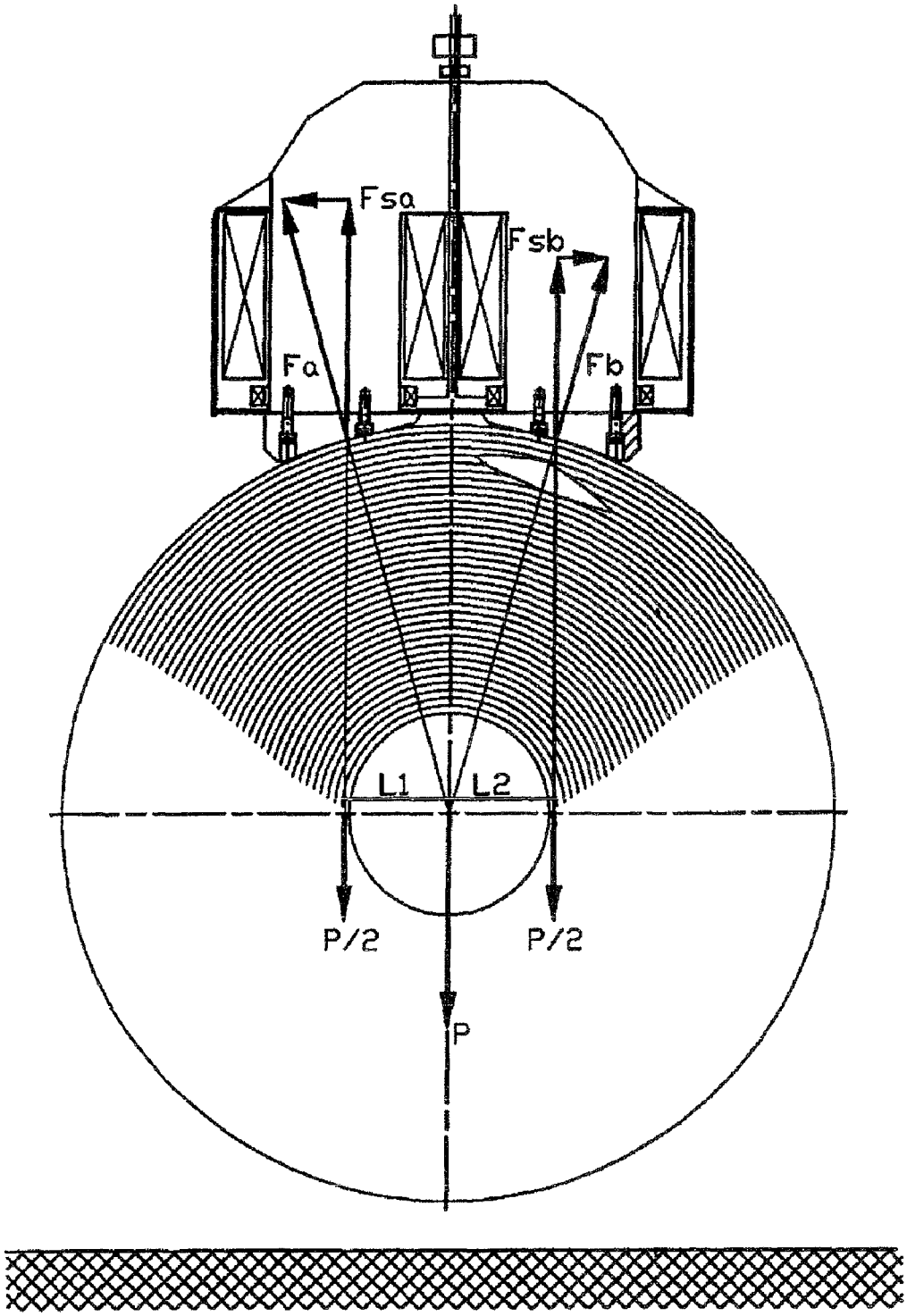
FIG. 4 is a view similar to the preceding one that shows the force system in a condition of asymmetric magnetic dynamism.

FIG. 4 shows a similar force system in condition of asymmetric magnetic dynamism, for example greater at pole b. In such a case it is Fa>Fb, therefore also Fsa>Fsb and Fsa*L1>Fsb*L2 whereby the lever effect against pole b can trigger the accelerated loosening of the turns on the same side greatly increasing the probability of load detachment.

During the first lifting step, the control unit 16 therefore performs a comparison of the magnetic dynamism occurring at the individual polarities on the basis of the data received from the detection coils 10, 11 through converters 14, 15. If the difference between the two values detected by coils 10, 11 exceeds a preset threshold that indicatively ranges from 3% to 10%, for example 5%, there is issued a signal for stopping the lifting operation and returning the load to the ground.

Figure 5:
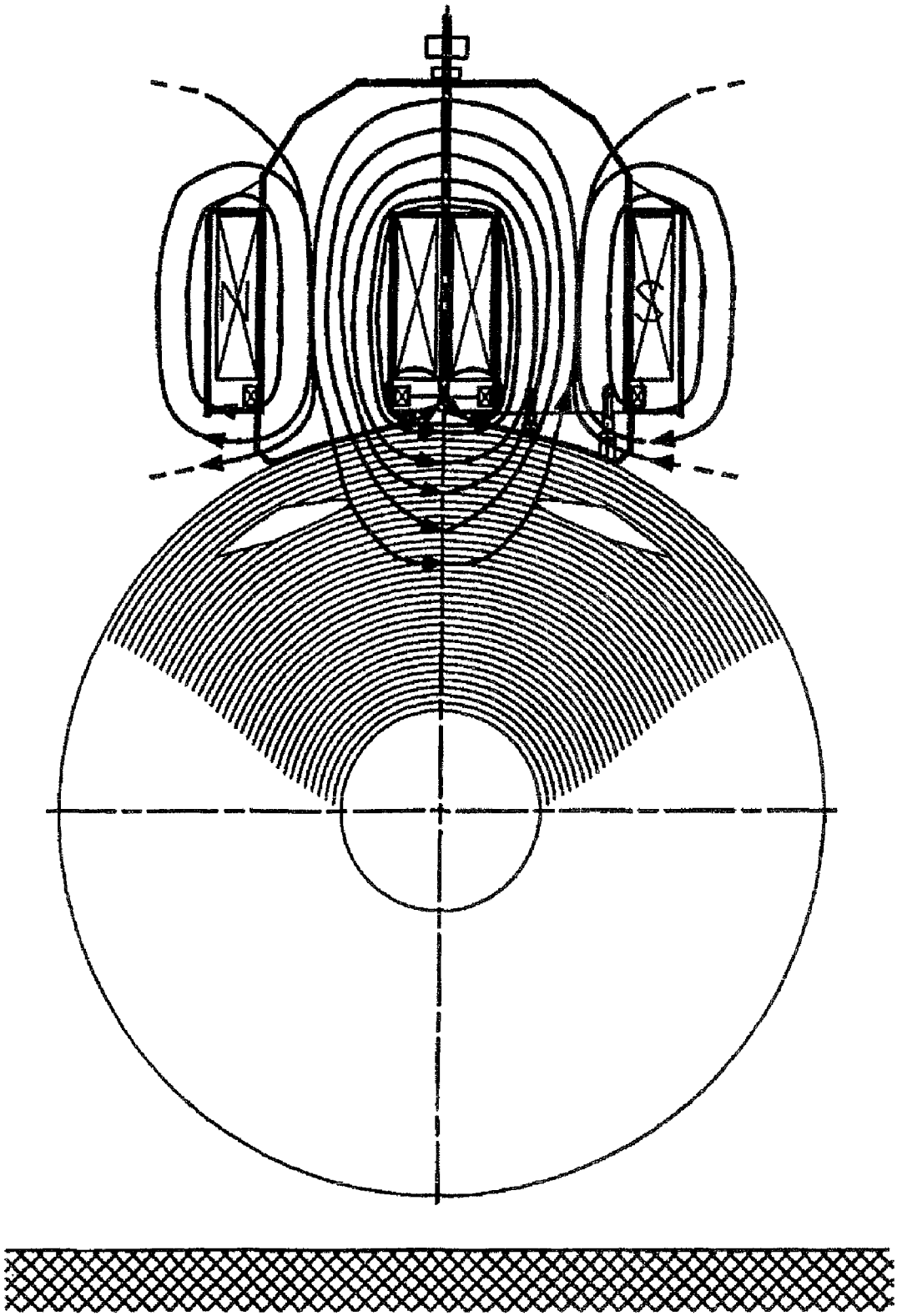
FIG. 5 is a view similar to FIG. 2 that diagrammatically shows the operation of the lifter in case of symmetric magnetic dynamism.

On the contrary, a decrease in the linked flux that remains at a value below the alarm threshold does not trigger further detachments of sheet turns and blocks the magnetic dynamism, maintaining an anchorage force such that the transport can be made safely according to the provisions of the EN 13155 standard.

Where the two signals detected by coils 10, 11 are almost equivalent, as illustrated in FIG. 5, in the immediately subsequent phase the control unit 16 checks that the overall magnetic dynamism of the system remains below the threshold set to authorize the transport, also in this case indicatively ranging from 3% to 10%. As a matter of fact, if the initial loosening of the turns remains within the parameters the phenomenon stops, whereby an overall decrease in the linked flux lower than, for example, another 5% allows to safely perform the transport. It should be noted that the safety and magnetic dynamism coefficients taken into consideration can be changed according to the needs of the case being considered.

The operating method of the electromagnetic lifter according to the present invention can therefore be summarized by the following steps:

a) activating the magnetization solenoids 8, 9;

b) checking that the flux linked to coil 4 to be transported is sufficient to achieve an anchorage force greater than twice the weight of coil 4;

c) initially lifting coil 4 and simultaneously comparing the magnetic dynamism occurring at the individual polarities to check that the difference between the values detected by coils 10, 11 is below a preset threshold;

d) in case of negative outcome of the check, issuing a signal for stopping the lifting operation and returning the load to the ground, and in case of positive outcome of the check performing a second check that the overall magnetic dynamism of the system is below a second preset threshold;

e) in case of negative outcome of the second check, issuing a signal for stopping the lifting operation and returning the load to the ground, and in case of positive outcome of the check issuing a signal of authorization to the transport of coil 4.

It is clear that the above-described and illustrated embodiment of the lifter according to the invention is just an example susceptible of various modifications. In particular, converters 14, 15 could be integrated in control unit 16 and coils 10, 11 could be replaced with similar devices suitable to detect the change in the linked flux.

The invention claimed is:

1. An electromagnetic lifter comprising at least two polar expansions shaped for transporting a horizontal axis coil of hot-rolled steel, said at least two polar expansions being connected through a ferromagnetic circuit and respective cores around which two magnetization solenoids are arranged, characterized in that it further includes at each of said cores a single detection coil arranged around said core so as to detect the change in the flux linked to said coil of hot-rolled steel, as well as a control unit operatively connected to said detection coils and suitable to compare the values detected by each coil in order to authorize or not the transport.

2. The electromagnetic lifter according to claim 1, wherein each detection coil is arranged close to the relevant polar expansion.

3. The electromagnetic lifter according to claim 2, wherein the detection coil is made of enamelled copper.

4. The electromagnetic lifter according to claim 2, wherein it further includes plates suitable to protect the detection coils from the heat transmitted by the coil of hot-rolled steel.

5. The electromagnetic lifter according to claim 1, wherein it includes A/D converters arranged between the detection coils and the control unit.

6. An operating method for an electromagnetic lifter according to claim 1, said method including the steps of:

a) activating the magnetization solenoids;

b) checking that the flux linked to the coil to be transported is sufficient to achieve an anchorage force greater than twice the weight of the coil;

c) initially lifting the coil and simultaneously checking that the difference between the values detected by the detection coils is below a preset threshold;

d) performing or not a second check that the overall decrease of the linked flux is below a second preset threshold, depending on the outcome of said first check; and e) issuing or not a signal of authorization to the transport depending on the outcome of said second check.

7. The operating method according to claim 6, wherein if the first check of step c) has a negative outcome step d) provides the issue of a signal for stopping the lifting operation and returning the load to the ground.

8. The operating method according to claim 6, wherein if the second check of step d) has a negative outcome step e) provides the issue of a signal for stopping the lifting operation and returning the load to the ground.

9. The operating method according to claim 6, wherein the preset threshold for the first check of step c) indicatively ranges from 3% to 10%.

10. The operating method according to claim 6, wherein the preset threshold for the second check of step d) indicatively ranges from 3% to 10%.

11. The operating method according to claim 9, wherein the preset threshold for the first check of step c) is 5%.

12. The operating method according to claim 10, wherein the preset threshold for the second check of step d) is 5%.

* * * * *